United States Patent [19]

Takeda

[11] Patent Number: 4,746,237

[45] Date of Patent: May 24, 1988

[54] TENSION ADJUSTING DEVICE OF CARRIAGE TRANSFER BELT

[75] Inventor: Takashi Takeda, Iwate, Japan

[73] Assignee: Alps Electric Co., Ltd., Japan

[21] Appl. No.: 870,779

[22] Filed: Jun. 4, 1986

[30] Foreign Application Priority Data

Jun. 4, 1985 [JP] Japan ..... 60-83391[U]

[51] Int. Cl.[4] ..... B41J 19/56

[52] U.S. Cl. ..... 400/335; 400/320; 400/322; 242/147 R

[58] Field of Search ..... 400/291, 331.2, 332.2, 400/335, 336, 341, 234, 320, 322; 242/147 R

[56] References Cited

U.S. PATENT DOCUMENTS

| | | | |
|---|---|---|---|
| 4,208,141 | 6/1980 | Jagger | 400/335 |
| 4,395,151 | 7/1983 | Klenz | 400/335 X |
| 4,479,731 | 10/1984 | Kawaguchi | 400/335 X |
| 4,487,518 | 12/1984 | Ermini | 400/335 X |
| 4,507,102 | 3/1985 | Geis et al. | 400/320 X |
| 4,653,948 | 3/1987 | Ikeda | 400/335 |

FOREIGN PATENT DOCUMENTS

| | | | |
|---|---|---|---|
| 3210758 | 7/1983 | Fed. Rep. of Germany | 400/332.2 |
| 3319671 | 12/1984 | Fed. Rep. of Germany | 400/335 |
| 32621 | 3/1980 | Japan | 400/335 |
| 32622 | 3/1980 | Japan | 400/335 |
| 169386 | 10/1982 | Japan | 400/332.2 |
| 1103725 | 1/1983 | Japan | 400/335 |

*Primary Examiner*—Edgar S. Burr
*Assistant Examiner*—James R. McDaniel
*Attorney, Agent, or Firm*—Guy W. Shoup

[57] ABSTRACT

A tension adjusting device of a carriage transfer belt which is characterized in that by a first bracket movable in the lengthwise direction of the belt a second bracket is supported rockably, by one end of the second bracket a pulley is supported, and to one end of the second bracket a spring is coupled for applying a turning force thereto, whereby a decrease in tension of the belt due to aged deterioration can be adjusted automatically.

4 Claims, 1 Drawing Sheet

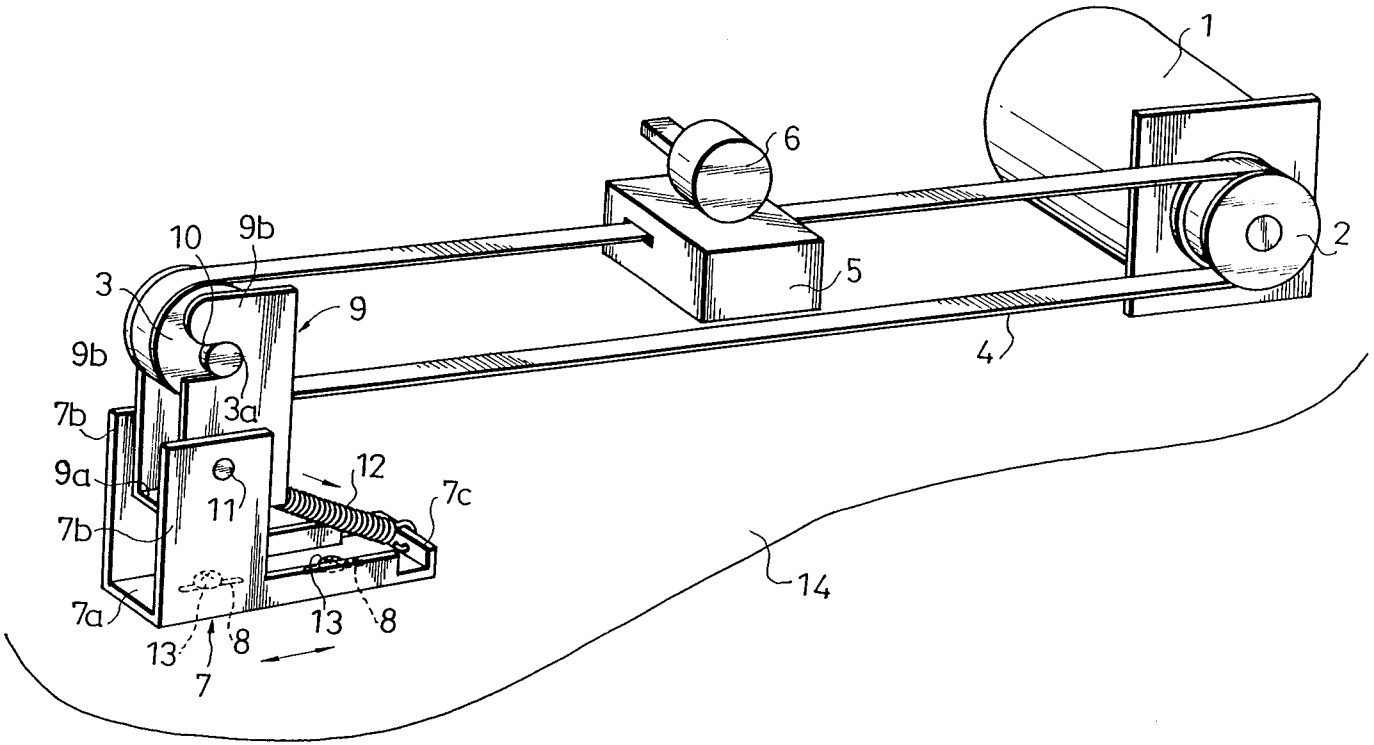
1
2
4
5
6
14
7c
12
8
13
9
9b
3a
11
8
7
10
13
3
9b
7b
9a
7b
7a

TENSION ADJUSTING DEVICE OF CARRIAGE TRANSFER BELT

BACKGROUND OF THE INVENTION

1. Field of the Invention

This invention relates to a tension adjusting device of a carriage transfer belt in a printer.

2. Description of the Prior Art

Hitherto, in driving devices of the printer for moving a carriage up to a given position via a belt coiled around a pulley, when the tension of the belt shows a change due to aging, such a change in tension of the belt is adjusted correspondingly by moving a bracket supporting the pulley around which the belt is coiled. However, because such a 'bracket is disposed inside the printer, the work of tension adjustment of the belt is very troublesome.

SUMMARY OF THE INVENTION

This invention has been devised to solve the foregoing problem of the prior art, and its general object is to provide a tension adjusting device of a carriage transfer belt which is not in need of adjusting the tension of a belt even if a change in tension appears due to aged deterioration.

To achieve the foregoing object, the present invention provides a tension adjusting device of a carriage transfer belt which is characterized in that by a first bracket movable in the lengthwise direction of the belt a second bracket is supported rockably, by one end of the second bracket a pulley is supported, and to one end of the second bracket a spring is coupled for applying a turning force thereto, whereby a decrease in tension of the belt due to aged deterioration can be adjusted automatically.

BRIEF DESCRIPTION OF THE DRAWING

The sole drawing is a perspective view of an embodiment of the present invention.

DESCRIPTION OF THE PREFERRED EMBODIMENT

In the sole drawing, reference numeral 1 indicates a motor, 2 in a pulley of one side to which the turning force of the motor 1 is transmitted directly, and 3 is a pulley of the other side, between the two pulleys 2 and 3 a belt 4 being engaged. 5 is a carriage fixed to the belt 4 which moves as the belt 4 moves, 6 is a head mounted on the carriage 5, and 7 is a first bracket comprising a bottom plate 7*a*, a pair of side plates 7*b* erecting from either margin in one end of the bottom plate 7*a*, and a folded portion 7*c* in the other end. 8 is a narrow hole bored in the bottom plate 7*a* and elongating in the lengthwise direction of the belt 4. 9 is a second bracket comprising a bottom plate 9*a* and a pair of side plates 9*b* formed by folding either marginal portion of the bottom plate 9*a*, with each side plate 9*b* having a concave portion 10 formed in an upper portion on its one side. The second bracket 9 is supported rockably by a shaft 11 between the side plates 7*b* of the first bracket 7, and a shaft 3*a* of the pulley 3 is fitted in the concave portions 10. 12 is a spring interposed between the bottom plate 9*a* of the second bracket 9 and the folded portion 7*c* of the first bracket 7.

At the beginning of assembly, the first bracket 7 is secured to a chassis 14 by screws 13 after the tension of the belt 4 is adjusted to a desired value while moving it appropriately in the direction of the arrow shown in the drawing.

The tension adjusting device of the carriage transfer belt according to the present invention has the foregoing configuration and the second bracket 9 is pulled by the spring 12 in the direction of the arrow shown in the drawing; thus, the upper portion of the side plate 9*b* is urged in the counterclockwise direction, and the concave portions 10 of the side plates 9*b* push the shaft 3*a* of the pulley 3 leftward in the drawing, thereby pushing the belt 4 always in the same direction as above.

Therefore, even if the belt 4 lengthens because of a long-term operation or due to heating thereby decreasing its tension, such an increase in length of the belt is absorbed by the elasticity of the spring 12, so that the tension of the belt 4 is always kept constant automatically.

In the foregoing embodiment of the present invention, even when the belt 4 lengthens due to aging and its tension decreases, such a decrease can be absorbed automatically by the elasticity of the spring 12; thus, there is the effect that the troublesome work of adjustment required in the prior art becomes unnecessary.

According to the present invention, since the second bracket is supported rockably the first bracket movable in the lengthwise direction of the belt, the pulley is supported by one end of the second bracket, and the spring is coupled to the second bracket for applying a turning force thereto, even if a decrease in tension of the belt appears due to aged deterioration, such a decrease of tension is absorbed by the elasticity of the spring provided between the first and second brackets and the constant tension is maintained automatically, accordingly, the work of tension adjustment for the belt can be achieved very easily and effectively in comparison with the conventional configuration.

What is claimed is:

1. A tension adjusting device for a carriage transfer belt which extends lengthwise in a longitudinal direction of a chassis with a driving source at one end and is entrained over a tension pulley at an opposite end, comprising:

a first bracket having a lower longitudinally extending plate mounted to said chassis, a mounting plate fixed so as to extend in an upright direction from said lower plate, and means for adjustably setting the position of said first bracket in the longitudinal direction of said chassis so that it can be fixed in a desired longitudinal position for putting tension on the tension pulley;

a second bracket pivotably mounted at an intermediate portion thereof to said mounting plate of said first bracket so as to pivotably extend in an upright direction from said lower plate, and having said tension pulley supported at an upper end of said second bracket; and a spring coupled between a lower end of said second bracket and an end of said lower plate of said first bracket so as to apply a spring-biased rotative lever force to said tension pulley supported on said upper end of said second bracket in the opposite longitudinal direction from said driving source using said intermediate portion as a fulcrum, such that said tension pulley applies a tension force on said belt.

2. A tension adjusting device of a carriage transfer belt according to claim 1, wherein said first bracket has a narrow hole elongating in the lengthwise direction of the belt for securing it to a chassis and for adjustment of its position.

3. A tension adjusting device of a carriage transfer belt according to claim 1, wherein said pulley is supported rotatably by its shaft received in concave portions formed in side plates of said second bracket.

4. A tension adjusting device of a carriage transfer belt according to claim 1, wherein said spring is coupled to said second bracket so as to increase the tension of the belt.

* * * * *